US007727014B2

(12) United States Patent
Zhu et al.

(10) Patent No.: US 7,727,014 B2
(45) Date of Patent: Jun. 1, 2010

(54) COAXIAL CONNECTOR HAVING AN INTEGRATED INSULATIVE MEMBER

(75) Inventors: Qing-Man Zhu, Kunshan (CN); Xiao-Guo Zhang, Kunshan (CN); Xue-Liang Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/436,791

(22) Filed: May 7, 2009

(65) Prior Publication Data

US 2009/0280683 A1 Nov. 12, 2009

(30) Foreign Application Priority Data

May 7, 2008 (CN) ..... 2008 2 0300678

(51) Int. Cl.
*H01R 9/05* (2006.01)

(52) U.S. Cl. ..... 439/578

(58) Field of Classification Search ..... 439/578, 439/581, 582

See application file for complete search history.

(56) References Cited

U.S. PATENT DOCUMENTS 4,666,231 A * 5/1987 Sheesley et al. ..... 439/581
5,062,811 A * 11/1991 Hackman ..... 439/620.03
5,413,504 A * 5/1995 Kloecker et al. ..... 439/620.03
6,780,051 B2 * 8/2004 Otsu ..... 439/578
6,822,542 B2 * 11/2004 Clark et al. ..... 333/260
6,932,616 B1 * 8/2005 Swantner et al. ..... 439/63

FOREIGN PATENT DOCUMENTS

CN 1835299 A 9/2006

* cited by examiner

*Primary Examiner*—Tho D Ta
(74) *Attorney, Agent, or Firm*—Ming Chieh Chang; Wei Te Chung; Andrew C. Cheng

(57) ABSTRACT

A coaxial connector (1, 1', 1") for being mounted on a panel (300) includes a metallic bracket (10, 10', 10") defining a receiving space (11, 11', 11") therein, an insulative member (20, 20', 20") mounted on the metallic bracket and a contact terminal (30, 30', 30") received in the securing portion. The insulative member has a securing portion (21, 21', 21") received in the receiving space and defining a passage (210, 210', 210"), and a mounting portion (22, 22', 22") integrated with the securing portion for being mounted on the panel. The contact terminal is received in the passage of the securing portion.

11 Claims, 11 Drawing Sheets

COAXIAL CONNECTOR HAVING AN INTEGRATED INSULATIVE MEMBER

BACKGROUND OF THE INVENTION

1. Field of the Invention

The present invention relates to a coaxial connector mounted on a panel and electrically connected with a mating electrical connector, and more particularly to a coaxial connector having an integrated insulative member instead of metallic shell for mounting on a panel.

2. Description of the Prior Art

Chinese Publication Patent No. CN 1835299A filed on Mar. 1, 2006 discloses a coaxial connector electrically terminated with a coaxial cable. The coaxial connector includes a metallic bracket defining a receiving space therein, a contact terminal assembled in the receiving space of the bracket via a first insulative member, and a second insulative member assembled to the outer surface of the metallic bracket for being mounted on a panel.

In assembly, firstly, the first insulative member should be formed by a molding process and then assembled in the receiving space of the metallic bracket. Secondly, the second insulative member is assembled to the outer surface of the metallic bracket by another molding process. That would result in complicating the process of assembly the coaxial connector and increasing the cost of manufacturing the coaxial connector. Additionally, the engagement between the metallic bracket and the second insulative member is unreliable.

Hence, an improved coaxial connector is needed to solve the above problem.

BRIEF SUMMARY OF THE INVENTION

An object of the present invention is to provide a coaxial connector having an integrated insulative member to ease the assembly of the coaxial connector, and while strengthen the engagement between the metallic bracket and insulative member.

In order to achieve the object set forth, a coaxial connector for being mounted on a panel includes a metallic bracket defining a receiving space therein, an insulative member mounted on the metallic bracket and a contact terminal received in the insulative member. The insulative member has a securing portion received in the receiving space and defining a passage, and a mounting portion integrated with the securing portion for being mounted on the panel. The contact terminal is received in the passage of the securing portion.

Advantages of the present invention are to provide a coaxial connector including an insulative member having a securing portion for securing the contact terminal and a mounting portion for being mounted on the panel. The securing portion is integrated with the mounting portion by one molding process to ease the assembly of the coaxial connector and strengthen the engagement between the metallic bracket and the insulative member.

Other objects, advantages and novel features of the invention will become more apparent from the following detailed description of the present embodiments when taken in conjunction with the accompanying drawings.

DETAILED DESCRIPTION OF THE INVENTION

Figure 1:
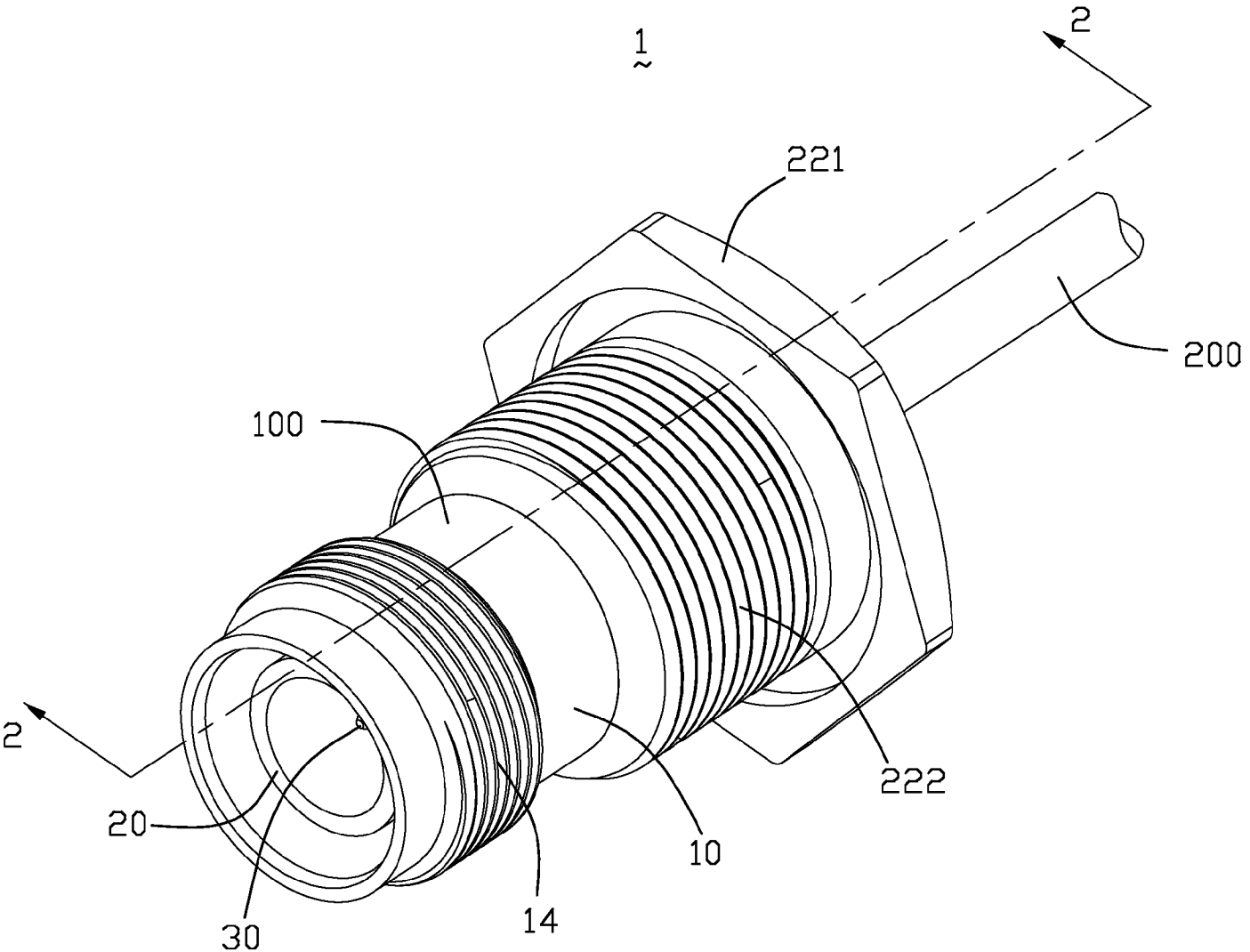
FIG. 1 is an assembled perspective view of a coaxial connector in accordance with a first embodiment of the present invention.

Reference will now be made to the drawing figures to describe the present invention in detail. Referring to FIGS. 1-5, a coaxial connector 1 in accordance with a first embodiment of the present invention includes a metallic bracket 10, an insulative member 20 assembled to the metallic bracket 10, and a contact terminal 30 assembled to the insulative member 20, and a cable 200 connected with the contact terminal 30.

Figure 4:
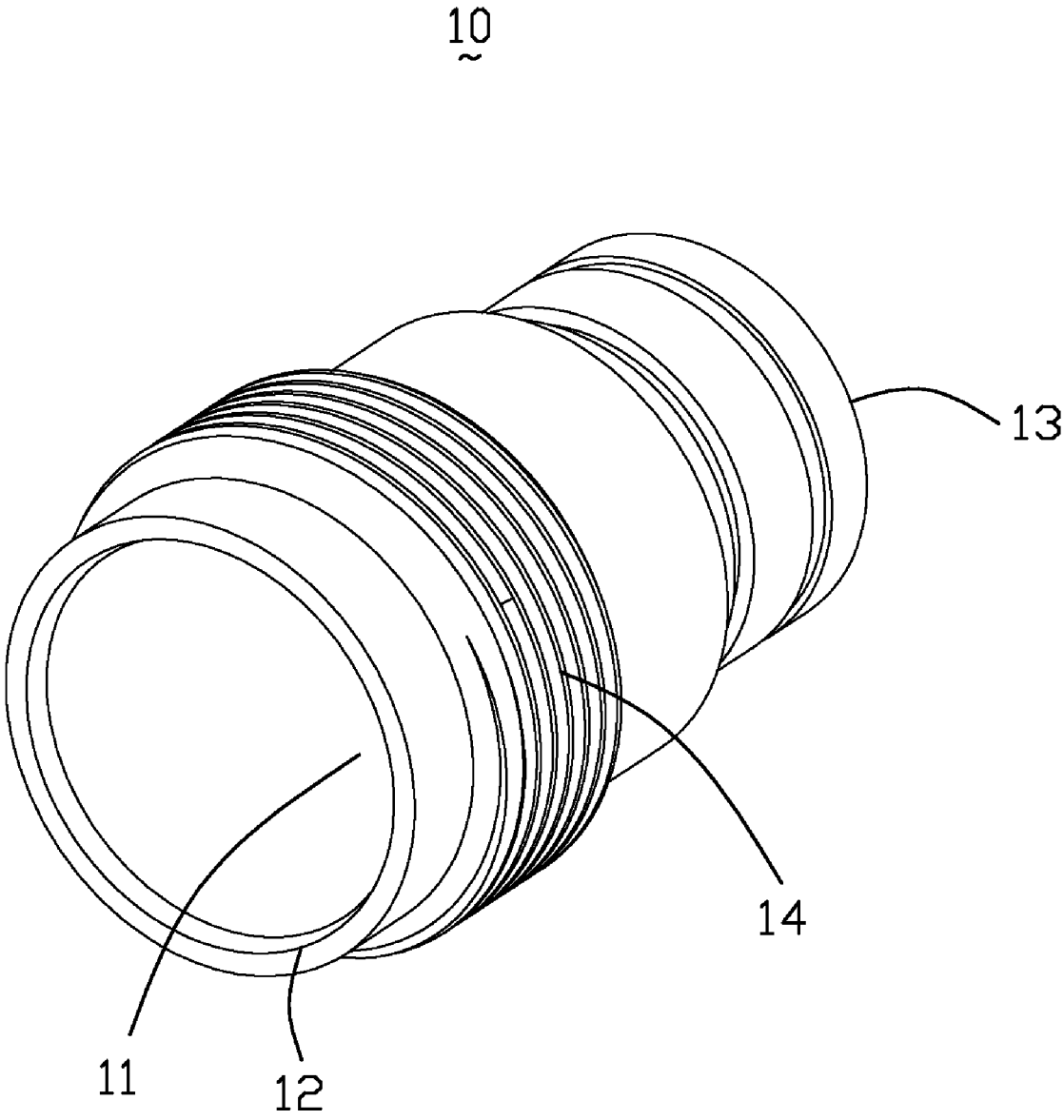
FIG. 4 is a perspective view of a metallic bracket of the coaxial connector as shown in FIG. 1.
Figure 5:
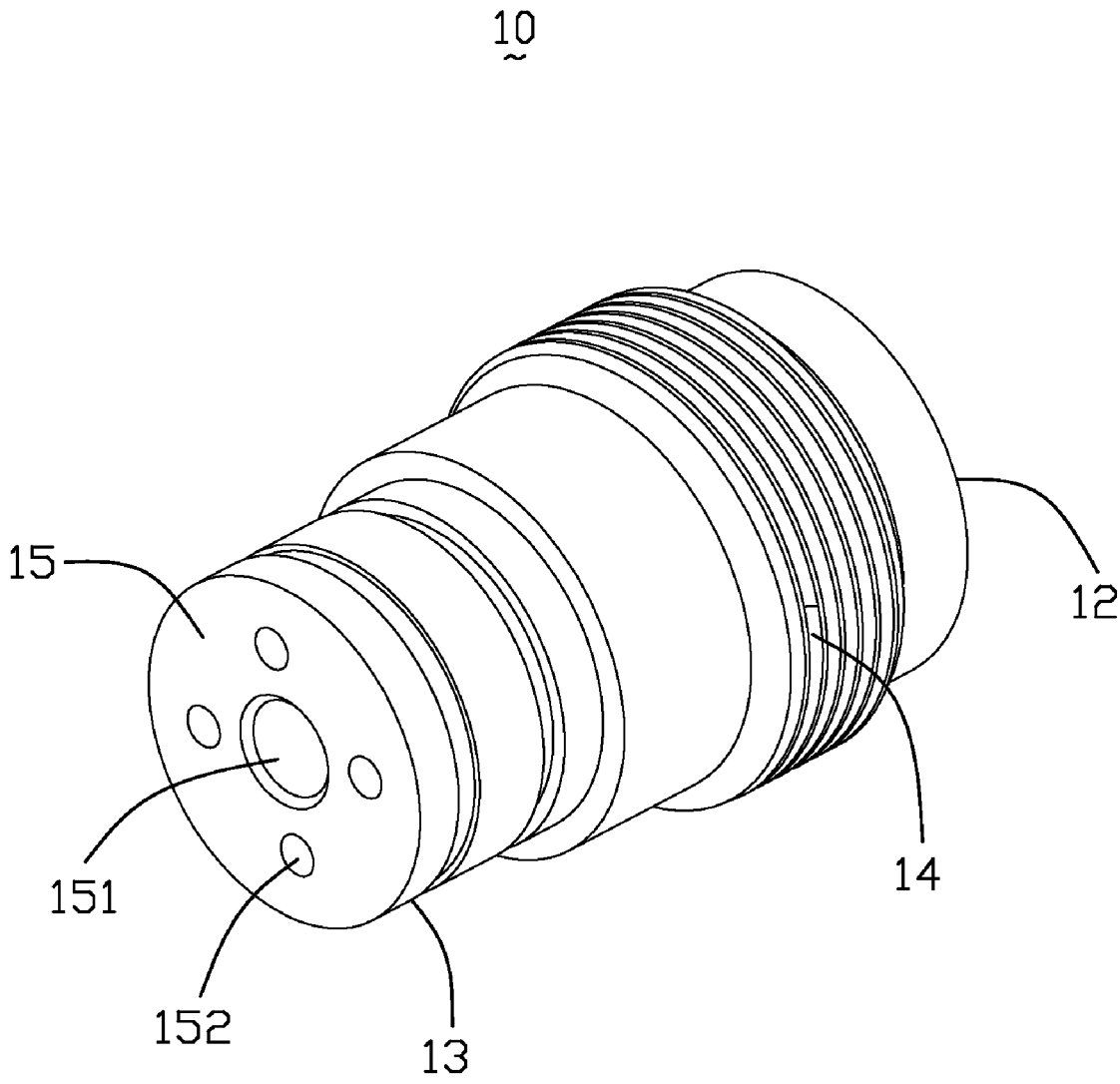
FIG. 5 is another perspective view similar to FIG. 3, taken from another aspect.

Referring to FIGS. 4 and 5, the metallic bracket 10 is made by a turning process on a screw machine or formed by an injecting casting process. The metallic bracket 10 has a cylindrical shape defining a receiving space 11 therein. The metallic bracket 10 has a front end 12 for mating with a mating electrical connector (not shown) and a rear end 13 for terminating with the coaxial cable 200. The metallic bracket 10 also has a first connecting portion 14 formed on an outer surface 100 thereof for mechanically and electrically connecting with the mating electrical connector. The metallic bracket 10 includes a bottom wall 15 disposed on the rear end 13. The bottom wall 15 defines a centric hole 151 and a plurality of through holes 152 communicating with the receiving space 11.

Figure 2:
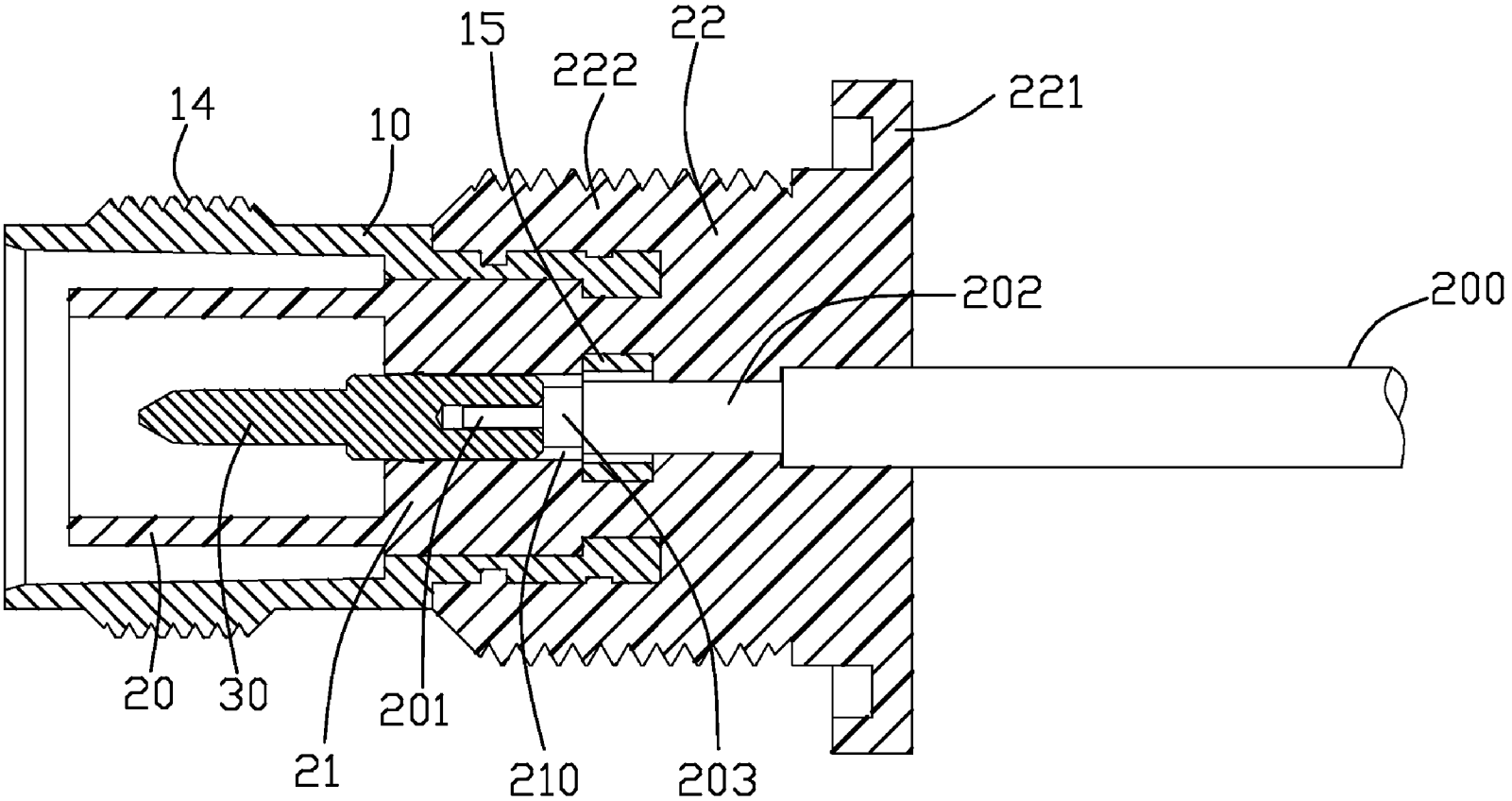
FIG. 2 is a cross-sectional view of the coaxial connector as shown in FIG. 1, taken along line 2-2.
Figure 3:
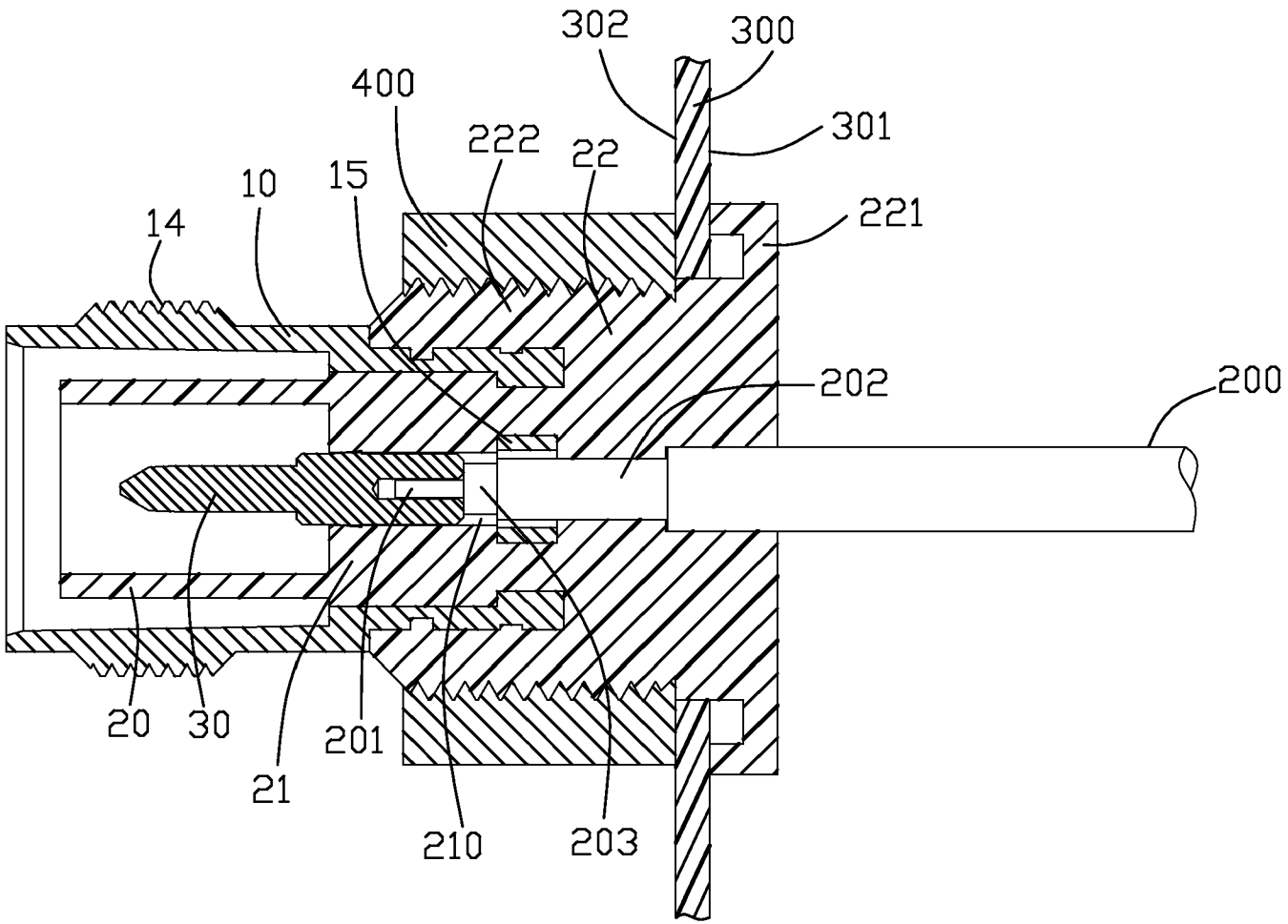
FIG. 3 is a cross-sectional view of the coaxial connector as shown in FIG. 1 when the coaxial connector is mounted on a panel and a nut mounted on the coaxial connector.

Referring to FIGS. 2 and 3, the coaxial cable 200 includes an inner conductor 201, a common shielding 202 and a dielectric material 203 disposed therebetween. The inner conductor 201 is surrounded by the dielectric material 203, and the dielectric material 203 is surrounded by the common shielding 202. The inner conductor 201 of the coaxial cable 200 extends through the centric hole 151 of the bottom wall 15 for electrically connecting with the contact terminal 30. The common shielding 202 of the coaxial cable 200 is electrically connected with the metallic bracket 10 via the bottom wall 15.

The insulative member 20 is assembled to the metallic bracket 10 by a molding process. The insulative member 20 includes a securing portion 21 disposed between the metallic bracket 10 and the contact terminal 30, and a mounting portion 22 disposed on the rear end 13 of the metallic bracket 10 and surrounding at least a portion of the metallic bracket 10. Insulative material is injected into the receiving space 11 of the metallic bracket 10 via the through hole 152 to form the securing portion 21. The securing portion 21 has a passage 210 defined therein for receiving the contact terminal 30. The mounting portion 22 has a flange portion 221 formed thereon and a second connecting portion 222 formed adjacent to the flange portion 221. When assemble the coaxial connector 100 to a panel 300, the coaxial connector 100 is inserted through an opening (not shown) defined on the panel 300, with the flange portion 221 abutting against a first surface 301 of the panel 300. Then assemble a nut 400 onto the mounting portion 22 of the insulative member 20 for mechanically connecting with the second connecting portion 222 and abutting against a second surface 302 opposite to the first surface 301 of the panel 300.

Figure 6:
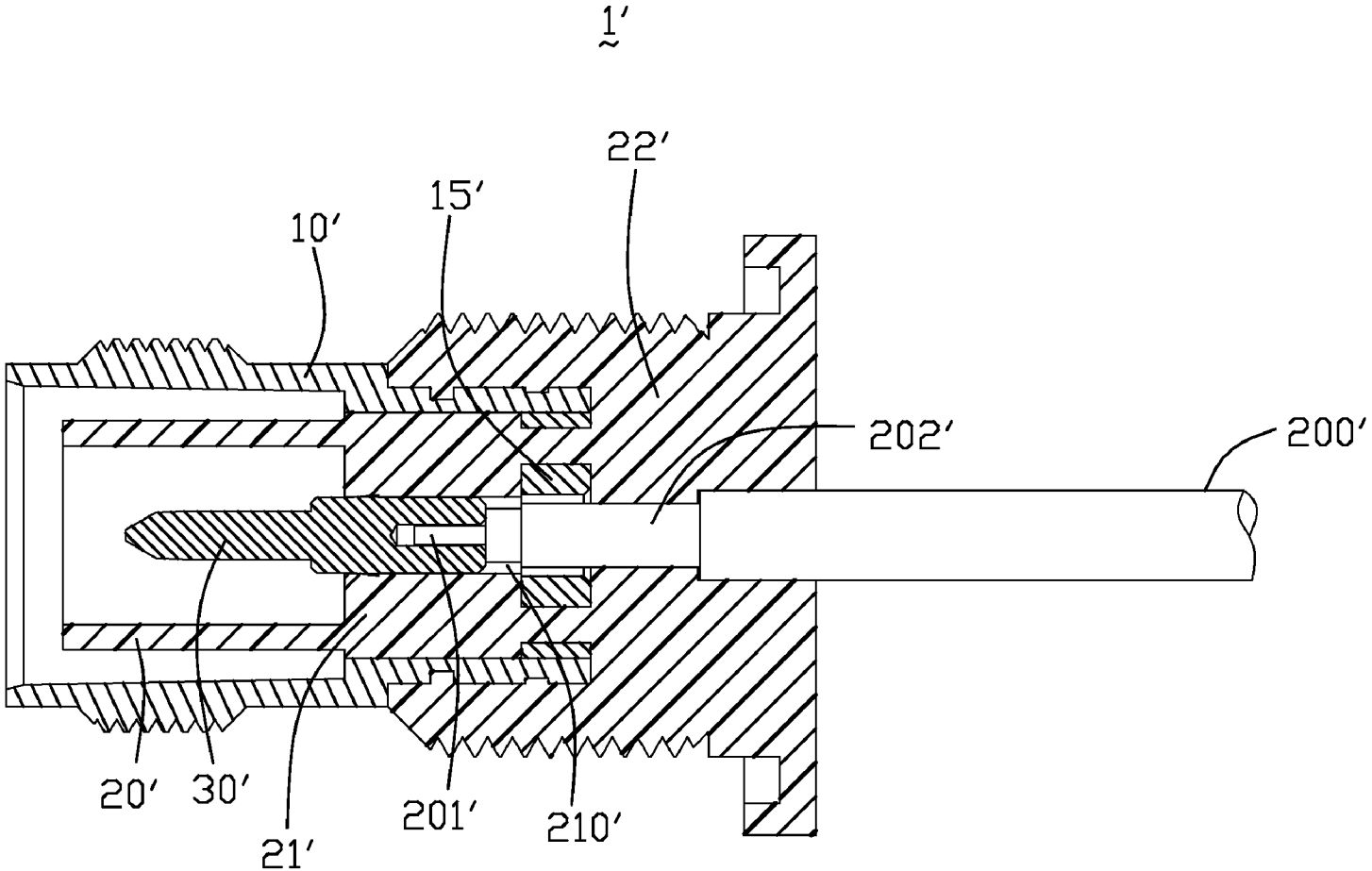
FIG. 6 is a cross-sectional view of a coaxial connector in accordance with a second embodiment of the present invention.
Figure 7:
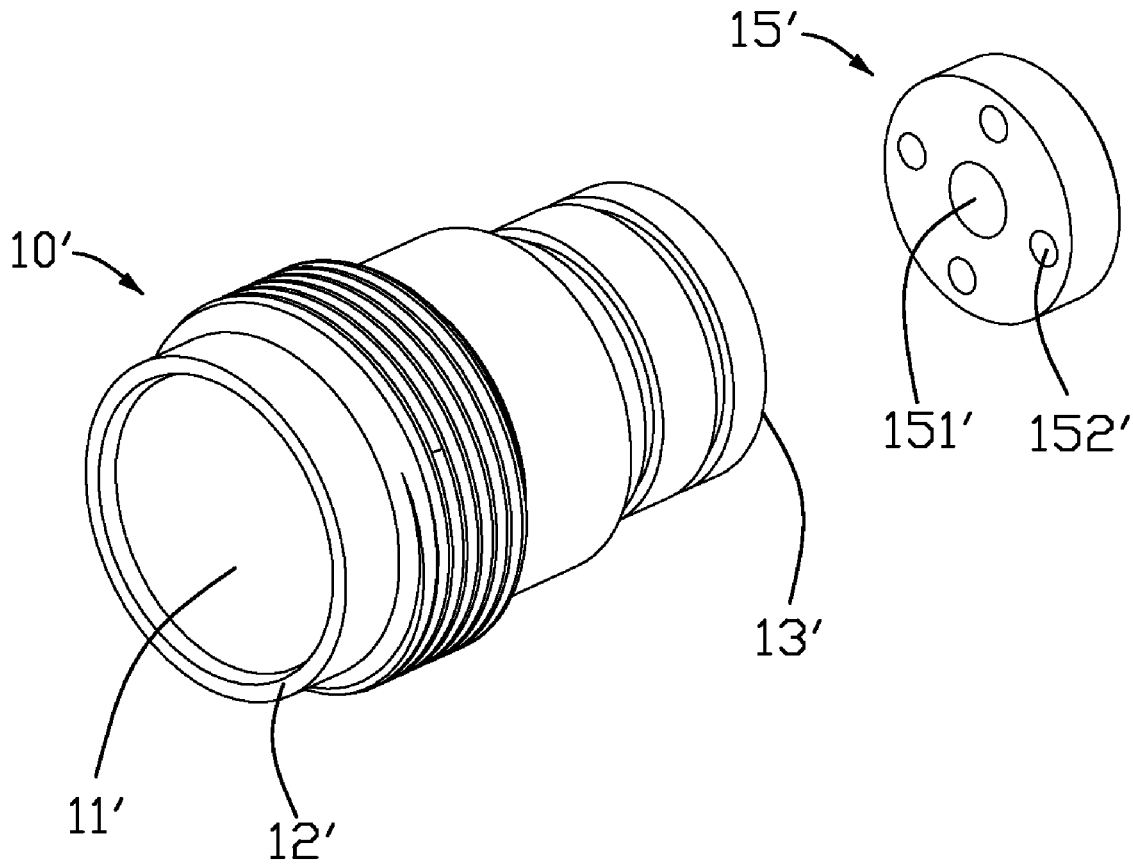
FIG. 7 is an assembled perspective view of a metallic bracket of the coaxial connector as shown in FIG. 6.
Figure 8:
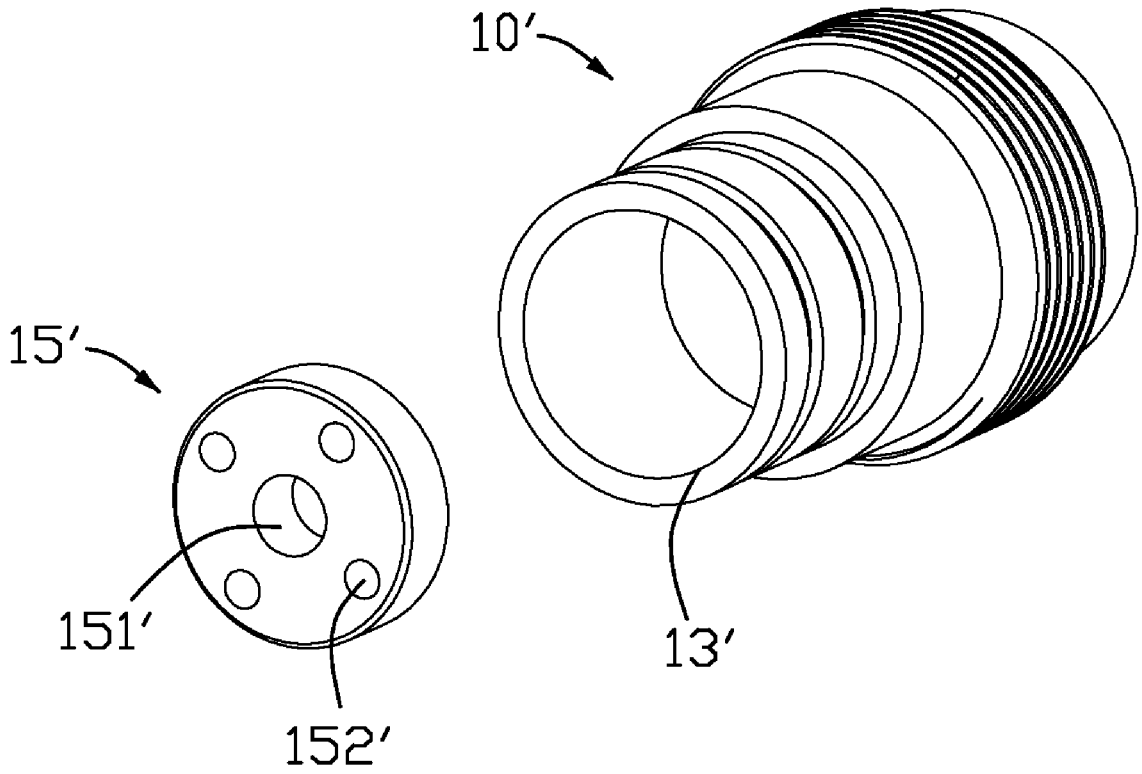
FIG. 8 is another assembled perspective view similar to FIG. 7, taken from another aspect.

Referring to FIGS. 6-8, a coaxial connector 1' made in accordance with a second embodiment of the present invention includes metallic bracket 10' defining a receiving space 11', an insulative member 20' assembled to the metallic bracket 10', and a contact terminal 30' assembled to the insulative member 20' and connected with a coaxial cable 200'. The metallic bracket 10' has a front opening 12' for insertion of a mating electrical connector and a rear opening 13' opposite to the front opening 12'. The metallic bracket 10' also has a collar 15' interfering with the rear opening 13'. The collar 15' has a centric hole 151' and a plurality of through holes 152' communicating with the receiving space 11'. The inner conductor 201' of the coaxial cable 200' extends through the centric hole 151' into the passage 210' for electrically connecting with the contact terminal 30', and the common shielding 202' of the coaxial cable 200' electrically connects with the metallic bracket 10' via the collar 15'. The insulative member 20' includes a securing portion 21' disposed between the metallic bracket 10' and the contact terminal 30', and a mounting portion 22' integrated with the securing portion 21' and covering on the outer surface of the metallic bracket 10'. Insulative material is injected into the receiving space 11' of the metallic bracket 10' via the through holes 152' to form the securing portion 21'.

Figure 9:
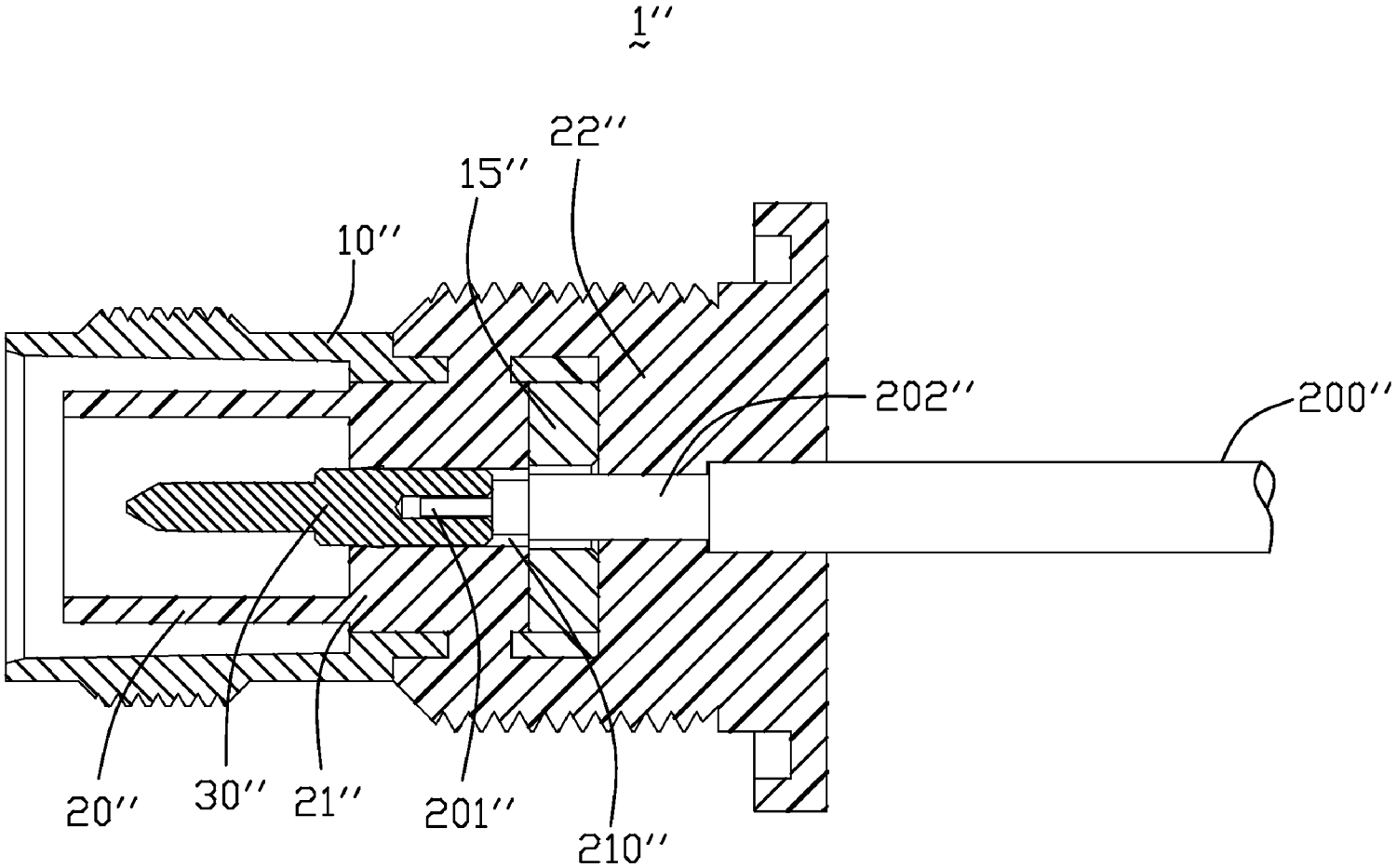
FIG. 9 is a cross-sectional view of a coaxial connector in accordance with a third embodiment of the present invention.
Figure 10:
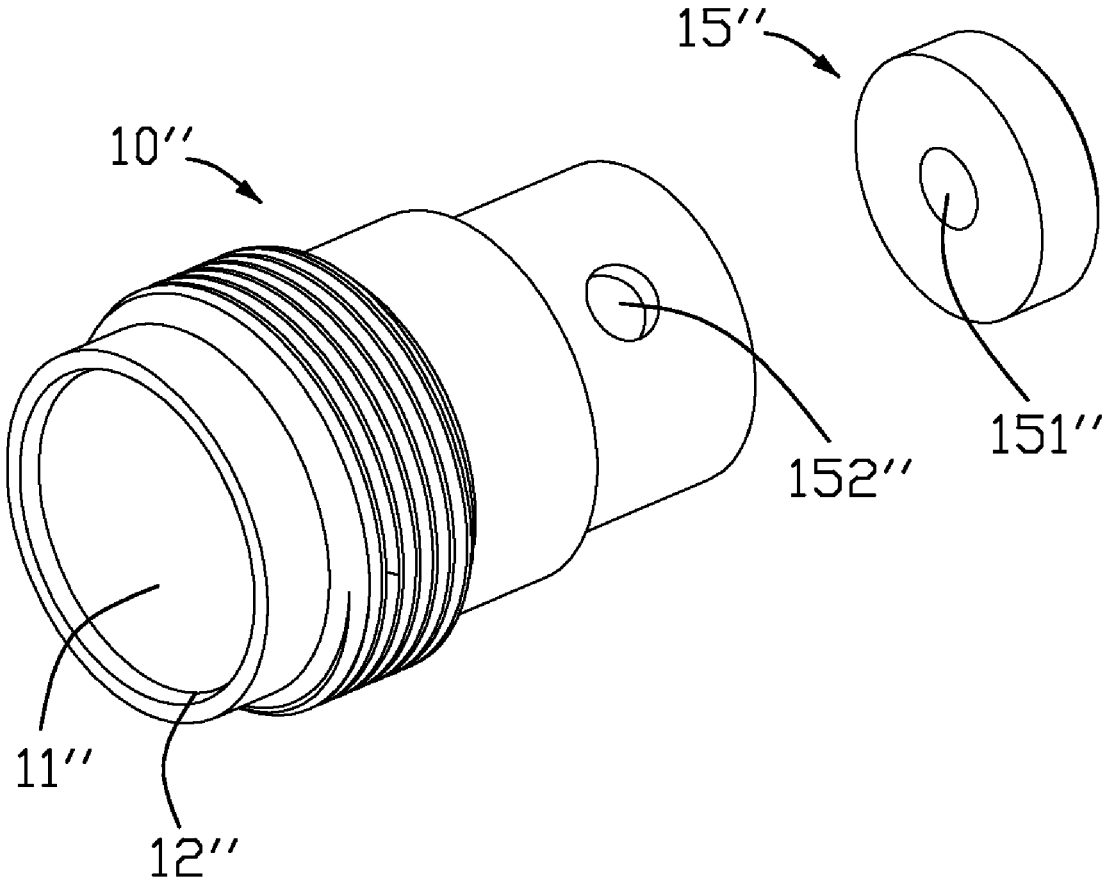
FIG. 10 is an assembled perspective view of a metallic bracket of the coaxial connector as shown in FIG. 9.
Figure 11:
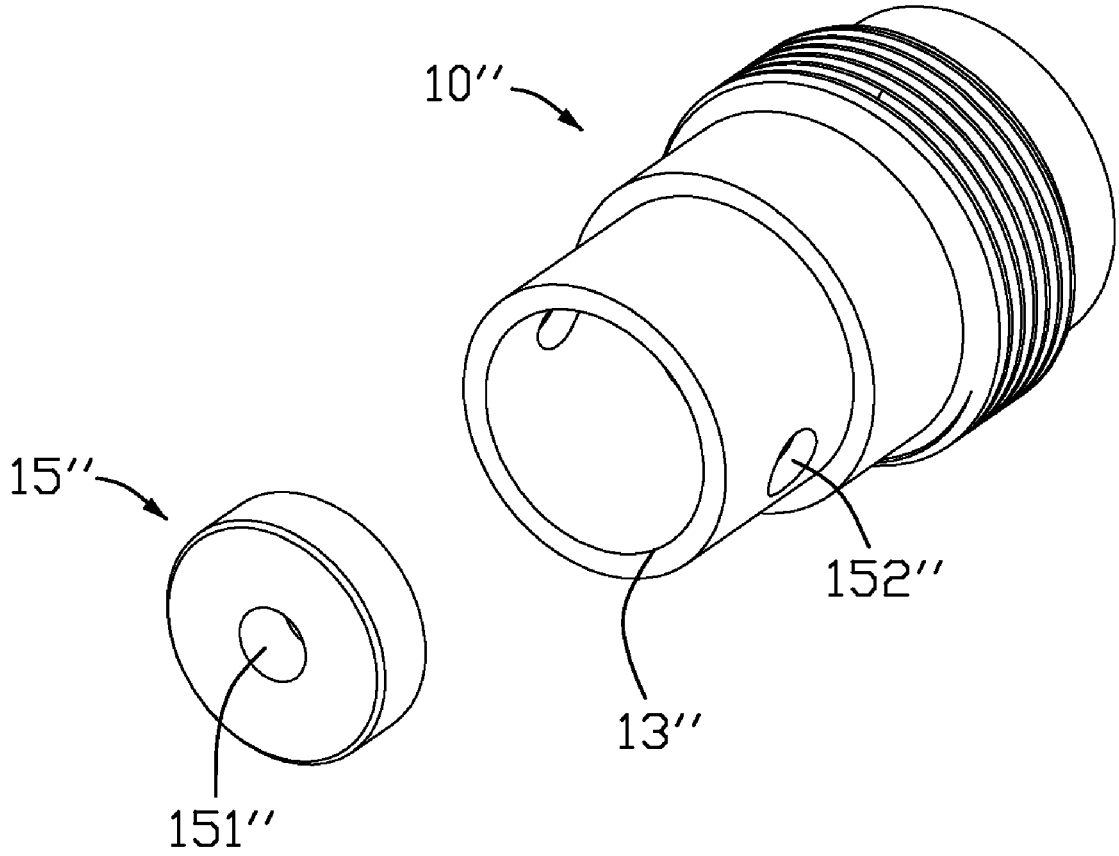
FIG. 11 is another assembled perspective view similar to FIG. 10, taken from another aspect.

Referring to FIGS. 9-11, a coaxial connector 1" in accordance with a third embodiment of the present invention includes metallic bracket 10", an insulative member 20" assembled to the metallic bracket 10", and a contact terminal 30" assembled to the insulative member 20" and connected with a coaxial cable 200". The metallic bracket 10" is of a cylindrical shape defining a receiving space 11". The metallic bracket 10" has a front opening 12" for insertion of a mating electrical connector, a rear opening 13" opposite to the front opening 12", and a plurality of through holes 152" communicating with the receiving space 11'. The insulative member 20" includes a securing portion 21" disposed between the metallic bracket 10" and the contact terminal 30", and a mounting portion 22" integrated with the securing portion 21" and covering on the outer surface of the metallic bracket 10". Insulative material is injected into the receiving space 11" of the metallic bracket 10" via the through holes 152" to form the securing portion 21". The metallic bracket 10" also has a collar 15" interfering with the rear opening 13". The collar 15" has a centric hole 151" defined thereon. The inner conductor 201" of the coaxial cable 200" extends through the centric hole 151" into the passage 210" of the securing portion 21" for electrically connecting with the contact terminal 30". The common shielding 202" of the coaxial cable 200" is electrically connected with the metallic bracket 10" via the collar 15".

The coaxial connector 1, 1', 1" has an insulative member 20, 20', 20" having a securing portion 21, 21', 21" for securing the contact terminal 30, 30', 30", and a mounting portion 22, 22', 22" mounted on the panel. The securing portion 21, 21', 21" is integrated with the mounting portion 22, 22', 22" by a molding process to ease the assembly of the coaxial connector 1, 1', 1" and while strengthen the engagement between the metallic bracket 10, 10', 10" and the insulative member 20, 20', 20".

When assemble the coaxial connector 1, 1', 1", firstly, the metallic bracket 10, 10', 10" is produced by a turning process on a screw machine or formed by an injecting casting process. The collar 15', 15" is assembled into the metallic bracket 10', 10" (In the first embodiment, this process could be left out). Secondly, the insulative member 20, 20', 20" is mounted on the metallic bracket 10, 10', 10" by a molding process. Finally, the contact terminal 30, 30', 30" is connected with the inner conductor 201, 201', 201" of the coaxial cable 200, 200', 200" and assembled into the insulative member 20, 20', 20". It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A coaxial connector for being mounted on a panel, comprising:

a metallic bracket defining a receiving space therein;

an insulative member mounted on the metallic bracket, the insulative member having a securing portion received in the receiving space and defining a passage, and a mounting portion integrated with the securing portion for being mounted on the panel; and a contact terminal received in the passage of the securing portion;

a coaxial cable having an inner conductor, a dielectric material and a common shielding, the inner conductor surrounded by the dielectric material, the dielectric surrounded by the common shielding;

wherein said metallic bracket has a front end for mating with a mating electrical connector, a rear end opposite to the front end for connecting with the coaxial cable, and a bottom wall formed on the rear end;

wherein said bottom wall has a centric hole defined thereon, the inner conductor of the coaxial cable extending through the centric hole into the passage of the securing portion for electrically connecting with the contact terminal, and the common shielding of the coaxial cable electrically connected with the metallic bracket via the bottom wall;

wherein said bottom wall defines a plurality of through holes communicating with the receiving space of the metallic bracket, insulative material injected into the receiving space of the metallic bracket via the through holes to form the securing portion.

2. The coaxial connector assembly as claimed in claim 1, wherein said metallic bracket is produced by a turning process on a screw machine.

3. The coaxial connector as claimed in claim 1, wherein said metallic bracket is formed by an injecting casting process.

4. The coaxial connector as claimed in claim 1, wherein said metallic bracket has a first connecting portion formed thereon for mechanically and electrically connecting with a mating electrical connector.

5. The coaxial connector as claimed in claim 1, wherein said insulative member is mounted on the metallic bracket by a molding process.

6. The coaxial connector as claimed in claim 1, wherein said mounting portion of the insulative member surrounds at least a portion of the metallic bracket.

7. The coaxial connector as claimed in claim 1, wherein said metallic bracket has a front opening for insertion of a mating electrical connector, a rear opening opposite to the front opening and a collar interfering with the rear opening.

8. The coaxial connector as claimed in claim 7, wherein said collar has at least one through hole communicating with the receiving space of the metallic bracket, insulative material injected into the receiving space of the metallic bracket via the through hole to form the securing portion.

9. The coaxial connector as claimed in claim 8, wherein said collar has a centric hole defined thereon, the inner conductor of the coaxial cable extending through the centric hole into the passage of the securing portion for electrically connecting with the contact terminal, and the common shielding of the coaxial cable electrically connected with the metallic bracket via the bottom wall.

10. The coaxial connector as claimed in claim 1, wherein said mounting portion of the insulative member has a flange portion formed thereon for abutting against the panel.

11. The coaxial connector as claimed in claim 10, wherein said mounting portion has a second connecting portion formed adjacent to the flange portion for mechanically connecting with a nut.

* * * * *